US007784526B2

(12) United States Patent
Harada et al.

(10) Patent No.: US 7,784,526 B2
(45) **Date of Patent: *Aug. 31, 2010**

(54) SAND-INTRODUCING DEVICE USING AIR, AND METHOD AND APPARATUS FOR PRODUCING MOLD

(75) Inventors: Hisashi Harada, Toyokawa (JP); Takuya Nitta, Toyokawa (JP); Takashi Hanai, Toyokawa (JP); Minoru Hirata, Toyokawa (JP); Kozo Sugita, Toyokawa (JP); Toshihiko Oya, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/588,337

(22) Filed: Oct. 13, 2009

(65) Prior Publication Data

US 2010/0032124 A1 Feb. 11, 2010

Related U.S. Application Data

(62) Division of application No. 11/882,057, filed on Jul. 30, 2007.

(30) Foreign Application Priority Data

| | | |
|---|---|---|
| Jan. 16, 2007 | (JP) | 2007-006731 |
| Feb. 9, 2007 | (JP) | 2007-030032 |
| May 17, 2007 | (JP) | 2007-131471 |

(51) Int. Cl.
*B22C 15/02* (2006.01)
*B22C 15/24* (2006.01)

(52) U.S. Cl. ..... 164/201; 164/21

(58) Field of Classification Search ..... 164/19–22, 164/200–202

See application file for complete search history.

(56) References Cited

U.S. PATENT DOCUMENTS

| | | | | |
|---|---|---|---|---|
| 3,183,570 | A * | 5/1965 | Vogt | 425/584 |
| 6,868,894 | B2 * | 3/2005 | Knudsen | 164/340 |
| 2002/0157800 | A1 * | 10/2002 | Kaneto et al. | 164/20 |

FOREIGN PATENT DOCUMENTS

JP 2001-259795 9/2001

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

A sand-introducing device that uses air for introducing molding sand in a molding space or spaces is provided. The device is provided with air-permeable partitioning plates that define a double-walled structure together with the wall of the body of the device. The air-permeable partitioning plates are easily produced, they can easily inject pressurized air of a desired pressure, and they will not need regular maintenance. The body of the device, which acts as a pressure tank, defines a double-walled structure together with the air-permeable partitioning plates (10, 11), thereby defining chambers (12, 13). In the sand-introducing device that uses air, while molding sand is fluidized by pressurized air injected from the air-permeable partitioning plates, it is introduced in a molding space. Each air-permeable partitioning plate is made of a porous resin or metal.

6 Claims, 5 Drawing Sheets

SAND-INTRODUCING DEVICE USING AIR, AND METHOD AND APPARATUS FOR PRODUCING MOLD

RELATED APPLICATIONS

This application is a divisional of U.S. application Ser. No. 11/882,057, filed Jul. 30, 2007 which claims priority of Japanese Application Nos. 2007-006731, filed Jan. 16, 2007, 2007-030032, filed Feb. 9, 2007, and 2007-131471, filed May 17, 2007, the contents of all of which are incorporated herein by reference.

FIELD OF THE INVENTION

This invention relates to a sand-introducing device that uses air and to a method and an apparatus for producing a mold or molds using that device, which device uses air for filling a molding space or spaces with molding sand. In particular, it relates to a sand-introducing device that has a body acting as a pressure tank, the body being arranged as a double-walled structure with the wall of the pressure tank and an air-permeable porous partitioning plate defining a chamber therebetween, wherein molding sand is fluidized by pressurized air injected through the partitioning plate and is then blow-filled in a molding space or spaces, and also relates to a method and an apparatus for making a mold or molds using that device, which device uses air for filling a molding space or spaces with the molding sand.

DESCRIPTION OF THE PRIOR ART

In JP 2001-259795A, which was laid open to the public on Sep. 25, 2001, the applicant proposed an apparatus that can fill a molding space defined by a pattern plate, a flask, a filling frame, and a plurality of squeeze feet appropriately and as required with molding sand by using air. The structure of this apparatus is as follows. The apparatus is one to fill a molding space defined by a pattern plate, a flask to be placed on the pattern plate, a filling flame, etc. to be placed on the flask, and the lower part of a sand-filling means, with molding sand by the sand-filling means by using air. The sand-filling means has an upper part arranged as a sand tank, a central part arranged as tapered chambers provided with a plurality of porous plates formed with numerous through-holes, and said lower part, which lower part is arranged as nozzles that can advance into the filling flame. The apparatus includes means mounted on each of said plurality of porous plates for injecting pressurized air toward the insides of the tapered chambers, and means mounted on the filling frame for controlling the exhaust of air from it. In operation, the squeeze feet are moved upward or downward so that their squeezing planes are spaced apart by a predetermined distance from the pattern portions of the pattern plate, thereby defining said molding space. When the molding sand is blow-filled, the molding sand in the tapered chambers is fluidized by appropriately injecting pressurized air from the means for injecting pressurized air, while the amount of the molding sand to be injected from the nozzles of the sand-filling means is increased or decreased, and further, the air to be exhausted from the filling flame is controlled by the means for controlling the exhaust of the air, to decrease or increase the rate of the molding sand to be blown from the nozzles, while the rate of the air to be exhausted from the pattern plate is controlled, thereby locally adjusting the density of the molding sand filled in the molding space.

By the way, the conventional molding-sand-filing apparatus as explained above uses plates, in each of which many through-holes of about 1 mm diameter are formed, as the porous plates for the sand-filling means that uses air. However, there are the following problems with these porous plates: producing them takes much time; since using these porous plates to fluidize molding sand as required will require a relatively high air pressure, much energy will be used for making a mold; and since the through-holes are clogged after successive uses, they must be regularly checked and cleaned.

SUMMARY OF THE INVENTION

The present invention has been conceived in view of the circumstances explained above. It aims to provide a sand-introducing device that uses air, and that has a body acting as a pressure tank of a double-walled structure formed with the wall of the pressure tank, and an air-permeable partitioning plate being able to be easily produced, that can easily inject pressurized air of a desired pressure, and that does not require regular maintenance, and also to provide a method and an apparatus that use the sand-introducing device for filling a molding space or spaces with molding sand.

To the above end, the sand-introducing device that uses air of the present invention is one that has a double-walled body defining a chamber as a pressure tank with the wall of the pressure tank and an air-permeable porous partitioning plate, wherein molding sand is fluidized by pressurized air injected from the air-permeable porous partitioning plate and then introduced into a molding space, characterized in that the air-permeable porous partitioning plate is formed from a porous metal or resin body.

Further, one aspect of the method of making a mold of the present invention is that it uses air to introduce molding sand into the molding space by using the sand-introducing device. This aspect is characterized in that after the molding space is defined, the pressurized air is injected from the air-permeable porous partitioning plate into the body of the sand-introducing device, to fluidize the molding sand, and also characterized in that air to be exhausted from the filling frame is controlled to increase or decrease the rate of the molding sand to be injected from the sand-introducing nozzles (ports) of the sand-introducing device, while the air to be exhausted from the pattern plate is controlled, thereby partially adjusting the density of the molding sand filled in the molding space.

Further, in another aspect of the method of making a mold of the present invention, the method is one that uses the sand-introducing device that uses air, characterized in that a match plate is held between a cope flask and a drag flask; a cope squeeze means and a drag squeeze means are introduced into openings of the flasks located opposite those openings of the flasks that are adjacent to the match plate, to define a molding space for an upper mold and a molding space for a lower mold; molding sand is then introduced and filled in the molding spaces for the upper and lower molds by using air, through the nozzles disposed under the sand-introducing device; and the cope squeeze and drag squeeze means are then advanced toward the match plate to squeeze the molding sand in the molding spaces, to simultaneously make an upper mold and a lower mold.

One aspect of the apparatus for making a mold of the present invention is that it uses the sand-introducing device that uses air, wherein a match plate is held between a cope flask and a drag flask; a cope squeeze means and a drag squeeze means are introduced into openings of the flasks located opposite those openings of the flasks that are adjacent to the match plate, to define a molding space for an upper mold and a molding space for a lower mold; molding sand is then introduced and filled in the molding spaces for the upper and lower molds by using air; the cope squeeze and drag squeeze means are then advanced toward the match plate to squeeze the molding sand in the molding spaces, to simultaneously make an upper mold and a lower mold, characterized in that the sand-introducing device that uses air for introducing the molding sand into the upper and lower molding spaces is tiltable in a vertical plane.

The air-permeable porous partitioning plate of the present invention is preferably made of material of a porous hydrophobic resin or a non-corrosive metal. Any hydrophobic resin can be used if it cannot absorb water and if it has a sufficient strength and a sufficient rigidity so that it is not deformed or damaged when installed. For example, a high polymer polyethylene is preferred. Further, any metal can be used, if it cannot rust because of moisture, and if it has a desired strength.

Further, preferably the air-permeable porous partitioning plate is a resin plate formed with many through-holes that are of an average diameter of 10-500 μm and smaller than the grain size of the molding sand, and that have a thickness of 5-20 mm more preferably, of an average diameter of 10-50 μm. If the plate is thinner than 5 mm, it would be deformed by the pressurized air. If the plate is thicker than 20 mm, the loss of the pressurized air would be great, and it would make it difficult to fluidize the molding sand. Further, the porosity of the through-holes (the total area of the through-holes in relation to the surface area of the plate) is preferably 25-50%, and, more preferably, 30-45%. Any method, for example, a sintering process, may be used to produce the plate.

From the foregoing description it is clear that since the air-permeable porous partitioning plate is formed as a porous resin or metal plate in the present invention of the sand-introducing device that has a body acting as a pressure tank, the body being arranged as a double-walled structure with the wall of the tank and an air-permeable porous partitioning plate defining a chamber therebetween, wherein pressurized air is injected from the air-permeable porous partitioning plate to fluidize the molding sand, and the fluidized molding sand is then blow-filled into the molding space, it yields significant advantages such as those wherein producing the air-permeable porous partitioning plate becomes easy; the plate can easily inject pressurized air of a desired pressure, the plate does not require regular maintenance, etc.

BEST MODE FOR CARRYING OUT THE INVENTION

The embodiments of a sand-introducing device that uses air for carrying out the present invention and a method and an apparatus that uses the sand-introducing device are explained below.

FIRST EXAMPLE

Figure 1:
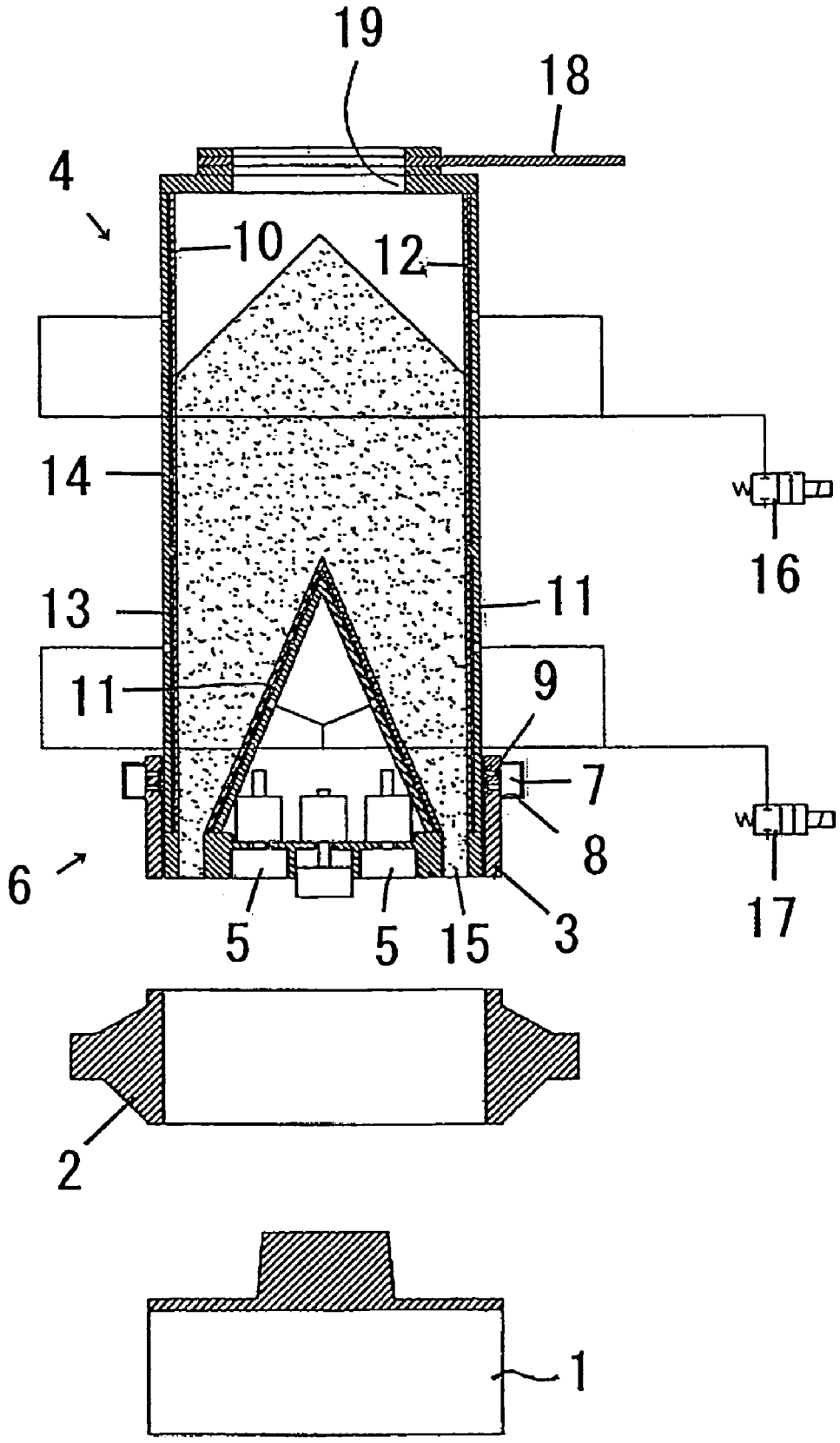
FIG. 1 is a schematic sectional view of a device for a tight-flask mold of an example of the present invention, showing the main part of the device.

An example of the molding apparatus according to the present invention will be now explained by reference to FIGS. 1-3. The molding apparatus is arranged, as shown in FIG. 1, so that molding sand is introduced and filled in a molding space defined by a flask 2 and a filling frame 3 to be placed on a pattern plate 1 by a sand-introducing device 4 that uses air. A plurality of squeeze feet, which can be moved upward and downward, are secured to the bottom of the sand-introducing device 4.

A plurality of vent plugs (not shown) are embedded in the pattern plate 1, so that air will be discharged by way of the vent plugs and a space (no reference number assigned) disposed at the bottom of the pattern plate. Further, an exhaust-controlling means 6 for controlling the exhaust of the pressurized air from the filling frame 3 is attached to the filling frame 3. The exhaust-controlling means 6 comprises a frame member 8 mounted on the periphery of the filling frame 3, for defining a sealed hollow chamber 7 together with the filling frame 3; an on/off valve (not shown) for having the hollow chamber 7 opened or closed to the atmosphere; and many fine apertures 9, 9 formed in the filling frame 3, for discharging the pressurized air through it into the hollow chamber 7.

Further, the sand-introducing device that uses air includes a body 14 defining a pressure tank of a double-walled structure with the entire wall of the body and two-pairs of upper and lower air-permeable porous partitioning plates 10, 11 and defining two, namely, upper and lower, chambers 12, 13, the body further defining at the lower part two (right and left) tapered chambers; sand-introducing ports 15 mounted on the lower end of the body 14, which can advance into the filling frame 3; and two on/off valves 16 and 17, which allow pressurized air sources (not shown) to be in fluid communication with the upper and lower chambers 12 and 13, respectively. Each air-permeable porous partitioning plate 10 or 11 is made of a porous resin plate that has many through-holes of an average diameter of 10-500 μm and that has a thickness of 5-20 mm. Each air-permeable porous partitioning plate is attached by means of sealing material. Further, the body 14 is provided with a sand-supplying aperture 19 at the top, which is to be opened of closed by a sliding gate 18.

The process to introduce and fill a given molding space with molding sand by using air from the stage shown in FIG. 1 is now explained. First, by using a known means the pattern plate 1, the flask 2, etc., are moved upward or downward so that they are placed on one another. The filling frame 3 is then moved downward and placed on the flask 2, and the lower part of the sand-introducing device that uses air and the squeeze feet 5, 5 are advanced into the filling frame 3. Further, the squeeze feet 5, 5 are then moved upward or downward so that their squeezing planes are spaced apart by a predetermined distance from the pattern portions of the pattern plate, which portions face the squeeze feet, thereby defining a molding space.

After the sand-supplying aperture 19 is closed by the sliding gate 18, the on/off valves 16, 17 are opened to supply pressurized air to the chambers 12, 13 to inject it through the air-permeable porous partitioning plates 10, 11 into the inside of the body 14 of the sand-introducing device 4 to fluidize the molding sand in the body 14 and to simultaneously press the upper surface of the molding sand by that injected air. It should be especially noted that since the molding sand in the tapered chambers of the body 14 is fluidized, the resistance of the molding sand in the tapered chambers to their inner surfaces can be reduced.

Further, by opening the on/off valves 16, 17 and by simultaneously and appropriately opening or closing the on/off valves of the exhaust controlling means 6 to control the exhaust of the pressurized air from the filling frame 3, the rate that the molding sand is injected from the sand-introducing ports 15, 15 is increased or decreased, while the rate that the air is exhausted through the vent plugs of the pattern plate is controlled. Thus the density of the molding sand filled in the molding space can be partially controlled. Accordingly, the molding sand is filled as required, and precisely, in the molding space at all places.

Figure 2:
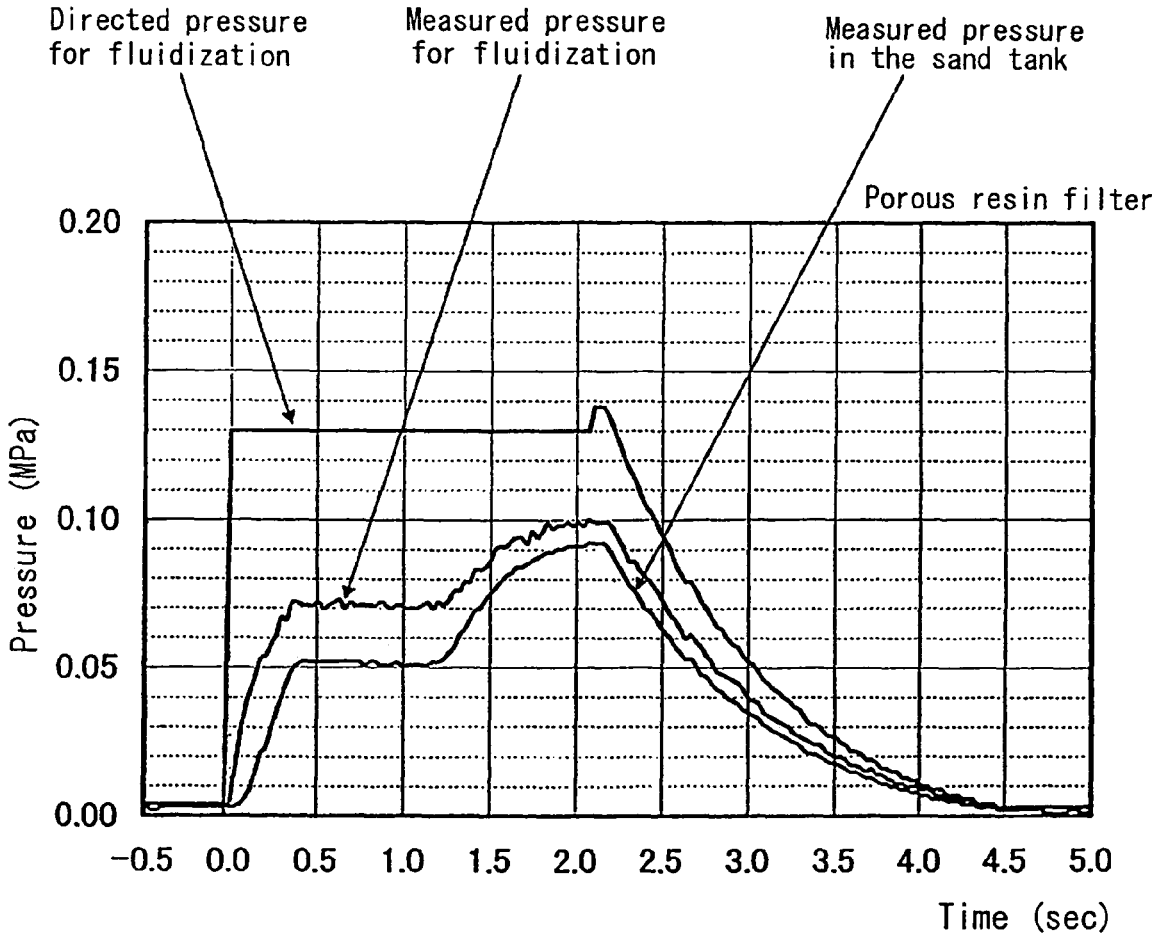
FIG. 2 is a graph showing the behavior of the pressure of the pressurized air when the molding sand is fluidized in relation to an air-permeable porous partitioning plate used for the device of FIG. 1.

When the pressurized air is supplied, by opening the on/off valves 16, 17, into the chambers 12, 13, and is injected through the air-permeable porous partitioning plates 10, 11, the behavior of the pressure of the pressurized air in the present invention is as shown in FIG. 2. The behavior of the pressure of the pressurized air when the conventional partitioning plate is used is as shown in FIG. 3.

Figure 3:
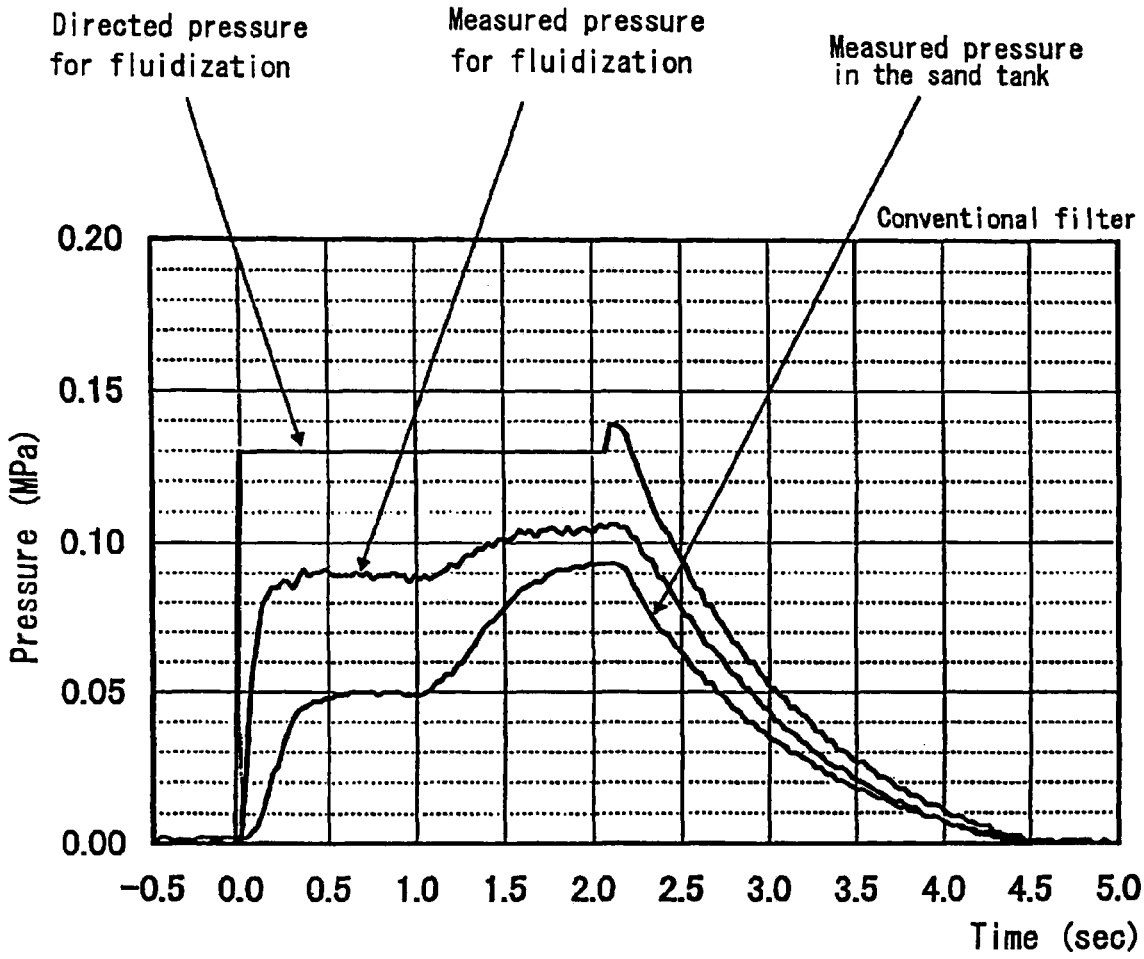
FIG. 3 PRIOR ART
FIG. 3 is a graph showing the behavior of the pressure of the pressurized air when the molding sand is fluidized when a conventional-porous plate is used, which plate has many through-holes, instead of the air-permeable porous partitioning plate used for the device of FIG. 1. This graph shows a comparison with the graph of FIG. 2.

The directed pressure for the fluidization as in FIGS. 2 and 3 is for the pressurized air that is to be supplied to the chambers 12, 13 and that is to be injected through the air-permeable porous partitioning plates 10, 11 to fluidize the molding sand in the body 14. The measured pressure for the fluidization is that of the pressurized air that is supplied to the chambers 12, 13 and injected through the air-permeable porous partitioning plates 10, 11 into the inside of the body 14 to fluidize the molding sand in the body 14 or that is supplied to the chambers located at the back of the conventional porous plates. The measured pressure in the sand tank is that in the body 14 or in the conventional sand tank.

The graphs of FIGS. 2 and 3 were compared and analyzed. The measured pressure for the fluidization in the present invention is lower than when a conventional porous plate is used. Thus it is understood that the air-permeable porous partitioning plates 10, 11 of the present invention can fluidize molding sand by injecting pressurized air at a pressure that is lower than that used for a conventional porous plate.

Although Example 1 described above is for a tight-flask molding, the invention is not limited to it. It is applicable to a flaskless mold that has been stripped from the flask 2 after the molding is completed. This will be explained below in Example 2.

Further, although in Example 1 described above the air-permeable porous partitioning plates 10, 11 are porous resin plates, the invention is not limited to them, and each plate may be any type of plate that has many through-holes that are smaller than the grain size of the molding sand and that is air-permeable, and that has a desired strength. For example, the plate may be a sintered metal plate.

EXAMPLE 2

Figure 4:
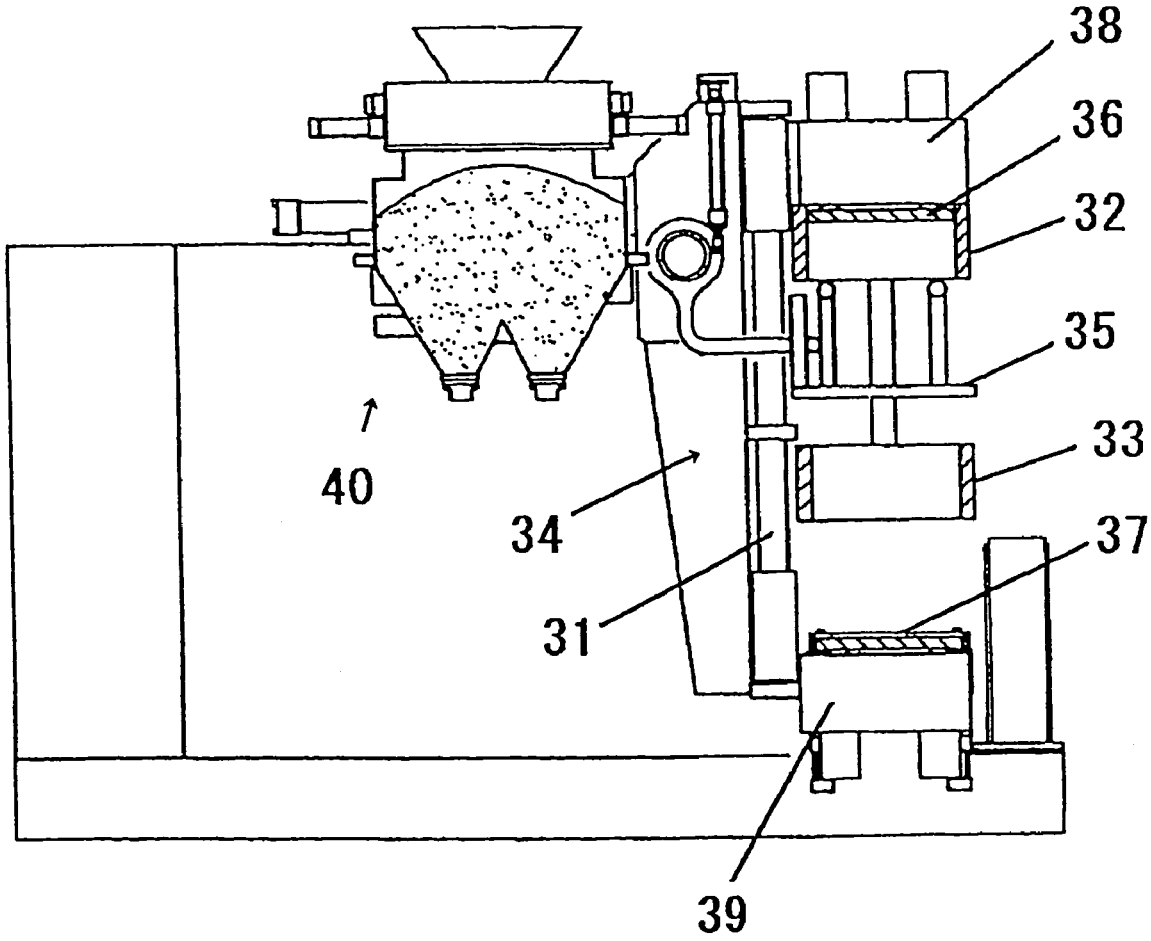
FIG. 4 is a fragmentary, sectional view of a device for making a flaskless upper mold and a flaskless lower mold of another example of the present invention, schematically showing the main part of the device.

The molding apparatus of the second example of the present invention for a flaskless molding is explained below by reference to FIG. 4.

The structure of the molding apparatus of this example may be that of a conventional molding apparatus for making a flaskless upper mold and a flaskless lower mold. The molding apparatus includes a pair of flasks, namely, a cope flask 32 and another drag flask 33, which are slidably mounted on a guide rod 31; a flask-moving device 34 for simultaneously moving the flasks between a central molding position where they mate and a spacing position where they are spaced apart; a match plate 35 to be held between the flasks 32 and 33 at the molding position; a pair of squeeze plates 36, 37 to be fittingly inserted in the flasks from their reverse sides; squeeze plate controlling means 38, 39 for independently setting the shift for each squeeze plate 36 or 37 to be moved in the corresponding flask and for independently controlling the shift of the squeeze plates 36, 37; and a sand-introducing device 40 that uses air for filling the flasks 32, 33 with molding sand, which flasks hold the match plate 35. The sand-introducing device 40 may be similar to the sand-introducing device 4, which uses air.

By sandwiching the match plate 35 between the cope flask 32 and the drag flask 33, and by closing the back openings of the flasks 32, 33 by the pair of squeeze plates 32, 33, two molding spaces, for an upper mold and a lower mold, are defined. The guide rod 31 is secured to the flask-moving device 34 and is arranged to rotate clockwise 90° with the flask-moving device 34 in a vertical plane from the position shown in FIG. 4. By that rotation, the molding spaces engage with the sand-introducing device 40 through sand-introducing ports (not shown) formed in the flasks 32, 33. Accordingly, the sand-introducing device 40, which uses air, can fill with the molding sand the molding spaces defined by the match plate 35, which is used in this example instead of the pattern plate 1, and by the cope and drag flasks 32, 33, and by the pair of squeeze plates 36, 37. (In FIG. 4 of this example, chambers that are similar to the chambers 12, 13 of the sand-introducing device 4 in FIG. 1, partitioning plates that are similar to the air-permeable porous partitioning plates 10, 11, and on/off valves that are similar to the on/off valves 16, 17 are not shown.)

Again in Example 2, as in Example 1, the effect of the air-permeable porous partitioning plate of the present invention was confirmed.

In the molding apparatus arranged as explained above for making a flaskless upper mold and a flaskless lower mold, a problem may be caused in that a shaded portion or portions located at the reverse of a pattern portion or portions of the match plate when viewed from the sand-introducing device may not be well filled with the molding sand. Thus, the molding apparatus of the third example of the present invention that can fill the shaded portions with the molding sand is explained below.

EXAMPLE 3

Figure 5:
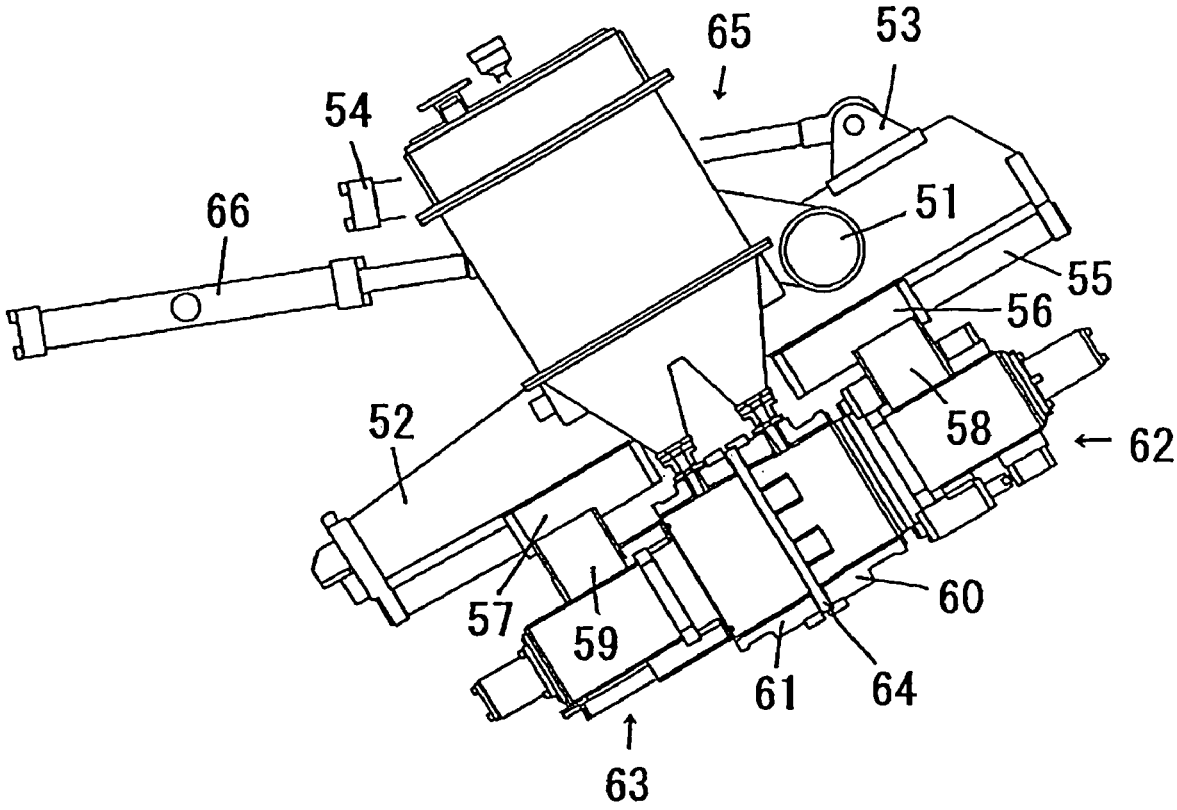
FIG. 5 is a fragmentary, sectional front view of a device for making a flaskless upper mold and a flaskless lower mold of a further example of the present invention, schematically showing the main part of the device.

FIG. 5 is a fragmentary, sectional view for schematically showing the molding apparatus of the third example of the present invention for making an upper mold and a lower mold. The molding apparatus is similar to the one shown in FIG. 4. As shown in FIG. 5, the main part of the molding apparatus for making an upper mold and a lower mold of this example includes a rotary frame 52 extending laterally and mounted on a supporting shaft 51 that is secured to the base (not shown) of the apparatus, so as to rotate vertically in a vertical plane; a laterally-facing cylinder 54 pivotably mounted on said base (not shown), the distal end of the piston rod of the cylinder being connected to the upper part of the rotary frame 52 (the right end of the rotary flame in FIG. 5) through at linkage 53 so that it can rotate vertically, the cylinder 54 acting for vertically rotating the rotary frame 52 by its extension and retraction; two spaced-apart guide rods 55, 55 secured to the bottom of the rotary frame 52 and extending alongside the bottom; a pair of opposing flask-moving members 58, 59 for moving a cope flask and a drag flask, respectively, connected to an upper and a lower guide holder 56, 57 respectively, which holders are in turn slidably mounted on the two respective guide rods 55, 55; a cope flask 60 and a drag flasks 61 mounted on the flask-moving members 58 and 59, respectively, the flasks having a sand-introducing ports in its sidewall; squeeze means 62 and 63 mounted on the flask-moving members 58 and 59, respectively, for squeezing molding sand filled in the cope flask 60 and the drag flask 61; a transferable match plate 64 to be disposed and held between the cope flask 60 and the drag flask 61; a sand-introducing device 65 mounted for being vertically rotated in a vertical plane about the rotary frame 52, which device uses air for introducing molding sand through the sand-introducing ports of flasks 60, 61 into molding spaces; another lateral cylinder 66 having a piston rod connected at it's distal end to the sand-introducing device 65, for vertically rotating the sand-introducing device 65 about the rotary frame 52 to allow the sand-introducing device 65 to engage with and to disengage from the sand-introducing ports of the flasks by its extension and retraction.

The sand-introducing device 65 that uses air as in Example 3 may be arranged as a pressure tank structure that uses the porous plates of the sand-introducing device 40 of Example 2.

In the operation of the molding apparatus arranged as explained above, while the sand-introducing device 65, which uses air, introduces molding sand into the molding spaces defined by inserting the squeeze means 62, 63 into openings of the flasks 60, 61 located opposite those openings of the flasks that are adjacent to the match plate 64 sandwiched by the flasks, the flasks, the match plate, the sand-introducing device 65, etc., are tilted at a desired angle, or they are being tilted. By this, the molding sand is easily fluidized in the molding spaces at the shaded portions, thereby enhancing the degree of molding sand filled in the shaded portions.

The examples explained above are only for exemplification, and it should be understood that the present invention is not limited to them. Clearly, one skilled in the art could modify the examples.

For example, in Example 3 the sand-introducing device 65 is arranged as a pressure tank structure that uses special porous plates that are the same as those of the sand-introducing device 40 of Example 2. However, instead of that structure, or together with it, molding sand may be blow-filled in a molding space using a conventional blow-filling method, i.e., by applying pressurized air from above to the surface of the molding sand from a source of pressurized air.

Although in Examples 2 and 3 the present invention is embodied as a molding apparatus that simultaneously produces a flaskless-upper mold and a flaskless lower mold, the molding apparatus may be one that separately produces a flaskless upper mold and a flaskless lower mold, i.e., one that produces one mold.

Further, although in the examples of the present invention the pressurized air is. separately supplied in the chambers 12 and 13 by opening the on/off valves 16, 17, the present invention is not limited to that arrangement. The chambers 12 and 13 may be combined as one chamber, and thereby only one on/off valve 16 or 17 may be used for supplying pressurized air in the chamber.

The invention claimed is:

1. A molding apparatus comprising:

a rotary frame mounted on a supporting shaft, for vertical rotation in a vertical plane;

a pair of opposing cope and drag flasks mounted on the rotary frame, each flask having a sand-introducing port in a sidewall thereof;

flask-moving means for moving the pair of flasks so that the flasks approach each other and are spaced apart for creating molding spaces and for stripping;

a sand-introducing device holding molding sand therein, for introducing the molding sand in the pair of opposing flasks through the sand-introducing ports thereof, and squeeze means for defining the molding spaces together with the approaching opposing flasks and a match plate sandwiched therebetween, and for squeezing the molding sand filled in the opposing flasks;

wherein the molding sand is introduced into the molding spaces while the molding spaces are tilted about a vertical line, wherein the sand-introducing device includes means for supplying pressurized air and has a body acting as a double-walled pressure tank structure with a wall of the body and an air-permeable porous partitioning plate made of a porous hydrophobic resin defining a chamber therebetween, and wherein while the molding sand in the sand-introducing device is fluidized by pressurized air injected from the pressurized air supplying means into the chamber of the pressure tank structure and through the air-permeable porous partitioning plate, the molding sand is introduced into the molding spaces.

2. The molding apparatus of claim 1, wherein the flask-moving means includes a pair of guide rods secured to the rotary frame and a pair of opposing flask-moving members slidably mounted on the pair of guide rods, the pair of opposing flasks being secured to the pair of flask-moving members.

3. The molding apparatus of claim 1, wherein the means for supplying pressurized air to the sand-introducing device through the air-permeable partitioning plate also simultaneously supplies pressurized air to an upper surface of the molding sand held in the sand-introducing device.

4. The molding apparatus of claim 1, wherein the partitioning plate is 5-20 mm thick and has many through-holes of an average diameter of 10-500 μm, and wherein said diameter is less than a grain size of the molding sand.

5. The molding apparatus of claim 4, wherein the average diameter is 10-50 μm.

6. The molding apparatus of claim 1, wherein the porous hydrophobic resin is high polymer polyethylene.

* * * * *